US008440924B2

(12) United States Patent
Ukai

(10) Patent No.: US 8,440,924 B2
(45) Date of Patent: May 14, 2013

(54) SWITCH UNIT WITH MULTI-LAYER RESIN SWITCH COVER

(75) Inventor: Toshimitsu Ukai, Aichi (JP)

(73) Assignee: Kabushiki Kaisha Tokia Rika Denki Seisakusho, Aichi (JP)

( * ) Notice: Subject to any disclaimer, the term of this patent is extended or adjusted under 35 U.S.C. 154(b) by 317 days.

(21) Appl. No.: 12/511,605

(22) Filed: Jul. 29, 2009

(65) Prior Publication Data

US 2010/0028597 A1 Feb. 4, 2010

(30) Foreign Application Priority Data

Jul. 30, 2008 (JP) ..... P2008-196203

(51) Int. Cl.
*H01H 1/64* (2006.01)

(52) U.S. Cl.
USPC ..... 200/293; 174/386; 174/524

(58) Field of Classification Search ..... 200/293; 174/377, 386, 524, 559
See application file for complete search history.

(56) References Cited

U.S. PATENT DOCUMENTS

| | | | | |
|---|---|---|---|---|
| 5,514,317 | A * | 5/1996 | Rosica et al. | 264/132 |
| 2004/0007471 | A1* | 1/2004 | Phu | 205/122 |
| 2005/0011736 | A1* | 1/2005 | Mori et al. | 200/5 R |
| 2005/0237443 | A1 | 10/2005 | Nakanishi et al. | |
| 2006/0072331 | A1 | 4/2006 | Yamaguchi et al. | |
| 2008/0124626 | A1 | 5/2008 | Murata et al. | |

FOREIGN PATENT DOCUMENTS

| | | |
|---|---|---|
| JP | 51-69071 | 6/1976 |
| JP | 5-259654 | 10/1993 |
| JP | 2005-309103 | 11/2005 |
| JP | 2006-103361 A | 4/2006 |
| JP | 2007-198483 A | 8/2007 |
| JP | 2008-130519 | 6/2008 |

OTHER PUBLICATIONS

Japanese Office Action dated Jun. 14, 2012 in Japanese counterpart application.

* cited by examiner

*Primary Examiner* — Vanessa Girardi
(74) *Attorney, Agent, or Firm* — Morgan, Lewis & Bockius LLP

(57) ABSTRACT

A switch unit includes a switch cover having an opening; a knob for operating a switch, the knob being provided within the opening in such a manner as to oscillate or rotate; and a parting line is set on a circumferential edge portion of the opening of the switch cover. The switch cover includes a first resin layer which is molded of a resin material having a property in which a plate layer does not adhere thereto, in which the opening is formed and which defines a rear side of the switch cover; a second resin layer which is molded of a resin material having a property in which a plated layer can adhere thereto and which is provided on a surface side of the first resin layer in such a manner as to be integral with the first resin layer; and a plated layer which is provided to cover a surface of the second resin layer.

3 Claims, 3 Drawing Sheets

SWITCH UNIT WITH MULTI-LAYER RESIN SWITCH COVER

BACKGROUND OF THE INVENTION

The present invention relates a switch unit in which a switch controlling control knob is disposed within an opening in a switch cover in such a manner as to oscillate or rotate and a plated layer is provided on a surface of the switch cover.

For example, in a case where a switch unit is fabricated which is configured in such a manner that a see-saw type control knob 3 as is shown in FIG. 4 is provided within an opening 2 in a switch cover 1 as is shown in FIG. 2 in such a manner as to swing up and down, escape portions 4 need to be formed on a rear side of the switch cover 1 for permitting the control knob 3 to oscillate or swing up and down as required. Then, in a case where the switch cover 1 configured in the way described above is molded of a resin, as is shown in FIG. 3, a parting line 5 needs to be set in the vicinity of a rotational locus 3*a* (refer to FIG. 4) of the control knob 3 on a circumferential edge portion of the opening 2. The parting line 5 is a line that is to be formed between parting faces of two molds (although not shown, in this case, two upper and lower molds) in resin molding, and after molding, a so-called flash 6 is formed on the parting line 5 as a result of part of the resin protruding from between the parting faces. There may occur a situation in which an electro-plate layer 7 (refer to FIG. 4) is required to be provided on the surface of the switch cover 1 configured in the way described above through electroplating for the purpose of increasing the design properties thereof.

As this occurs, in the event that an electro-plate layer 7 is attempted to be provided on the surface of the switch cover 1 in such a state that the flash 6 so formed remains thereon, the electro-plate layer 7 (refer to a chain double-dashed line in FIG. 3) is eventually formed on the surface of the flash 6, as well. In case this actually happens, when the control knob 3 is operated, the control knob 3 strikes against the portion where the flash 6 is formed, leading to a fear that the electro-plate layer 7 is stripped off therefrom. In order to avoid this, although the flash 6 is made to be removed before the electro-plate layer 7 is so provided, to remove the flash 6, the flash removing work needs to be carried out separately. In addition, depending upon shapes of switch covers, there may be a situation in which the flash removing work is made difficult to be carried out.

Due to this, conventionally, the switch unit has been regarded as being difficult to be fabricated in which the control knob 3 is disposed within the opening 2 in the switch cover 1 on the surface of which the electro-plate layer 7 is to be provided in such a manner as to oscillate or rotate.

In addition, although this is not related directly to a problem that the invention is to solve, a technique of two-color molding in which a resin to which a plated layer can adhere and a resin to which a plated layer does not adhere are molded one on the other is disclosed, for example, in JP-A-2005-309103 or Patent Document 2.

SUMMARY OF THE INVENTION

Then, an object of the invention is to provide a switch unit in which a switch controlling control knob is disposed within an opening in a switch cover on a surface of which a plated layer is provided in such a manner as to oscillate or rotate, wherein the stripping off of the plated layer can be prevented with a simple configuration.

With a view to achieving the object, according to an aspect of the invention, there is provided a switch unit comprising:

a switch cover having an opening; and a knob for operating a switch, the knob being provided within the opening in such a manner as to oscillate or rotate, wherein the switch cover comprises:

a first resin layer which is molded of a resin material having a property in which a plate layer does not adhere thereto, in which the opening is formed and which defines a rear side of the switch cover;

a second resin layer which is molded of a resin material having a property in which a plated layer can adhere thereto and which is provided on a surface side of the first resin layer in such a manner as to be integral with the first resin layer; and a plated layer which is provided on a surface of the second resin layer in such a manner as to cover the surface of the second resin layer.

In the aspect of the invention, in the switch cover, the first resin layer is molded of the material to which the plated layer does not adhere. This first resin layer is made to constitute the rear sides of the opening and the switch cover. In addition, the second resin layer is molded of the material to which the plated layer can adhere is molded on the surface side of the first resin layer in such a manner that the first resin layer and the second resin layer are formed integrally with each other. Thereafter, the plated layer is formed on the surface of the second resin layer. As this occurs, since the plated layer does not adhere to an exposed surface of the first resin layer, no plated layer is formed on an inner circumferential surface of the opening formed by the first resin layer. Because of this, even in the event in molding the first resin layer, a parting line is set on a circumferential edge portion of the opening and a flash is formed thereon, since the plated layer does not adhere to the flash, there occurs no such situation that the plated layer is stripped off therefrom.

DETAILED DESCRIPTION OF PREFERRED EMBODIMENTS

Figure 1:
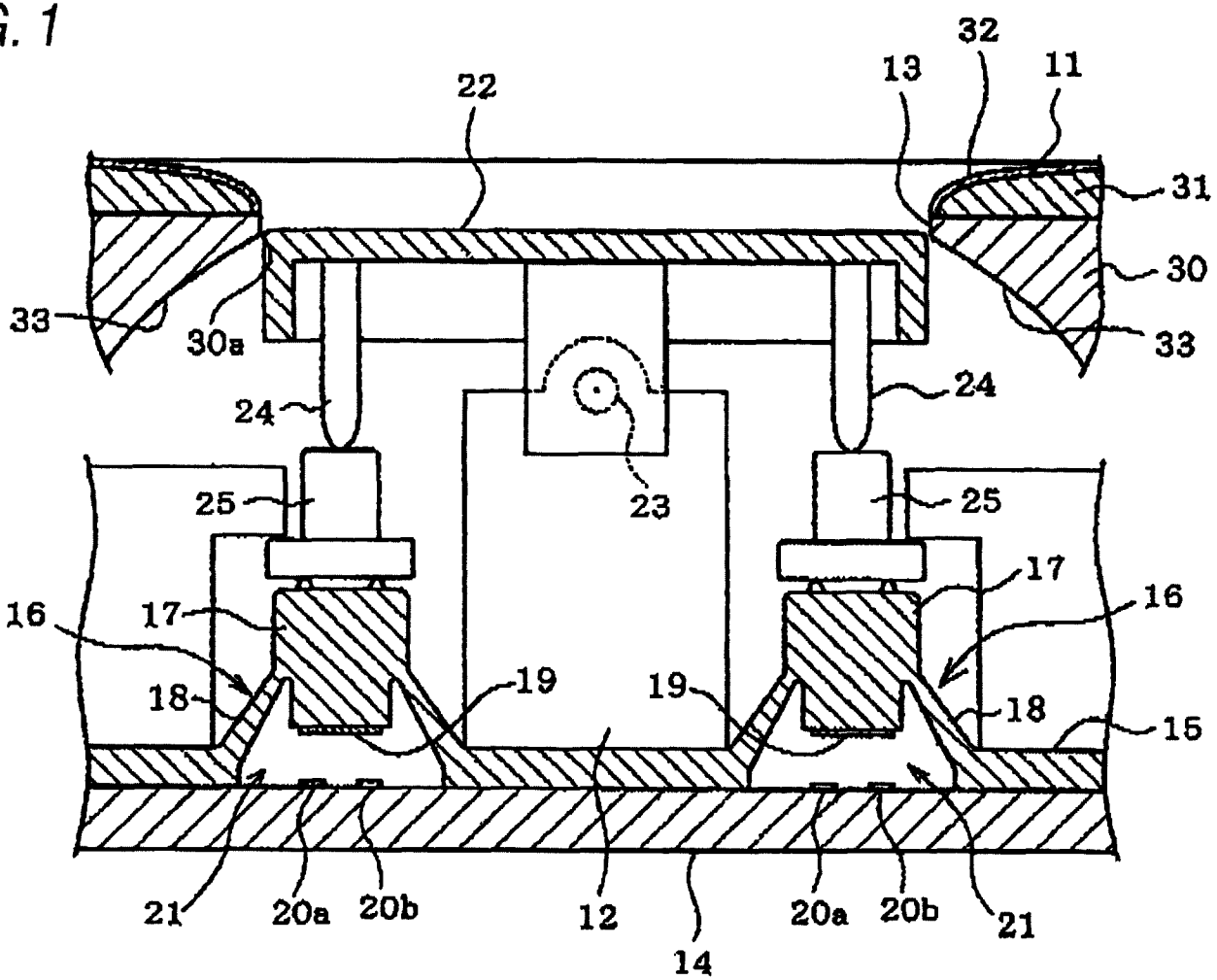
FIG. 1 is a vertical sectional view of a switch unit depicting an embodiment of the invention.
Figure 2:
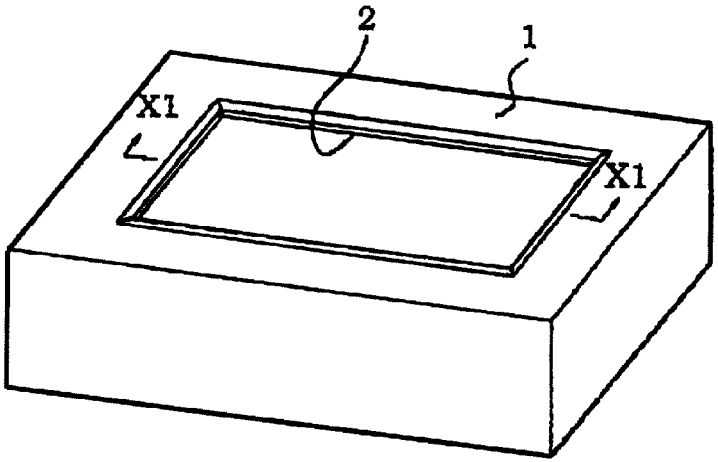
FIG. 2 is a perspective view depicting an external appearance of a related-art switch cover.
Figure 3:
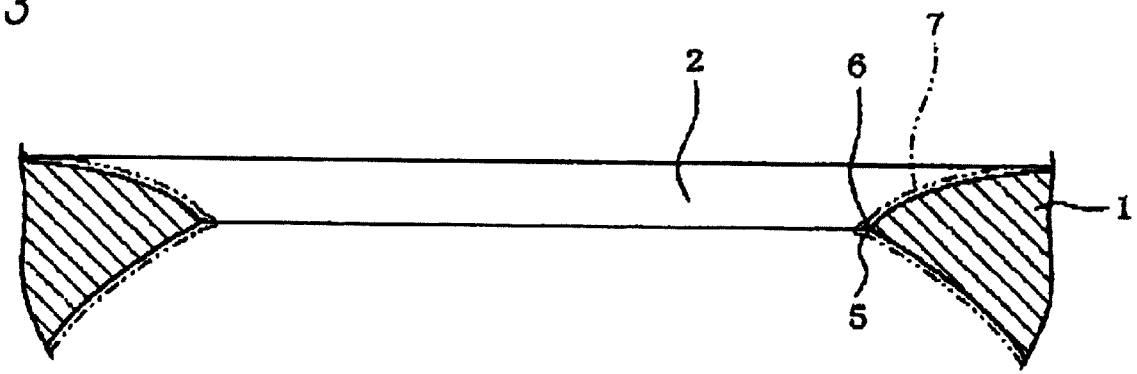
FIG. 3 is a vertical sectional view taken along the line X1-X1 in FIG. 2.
Figure 4:
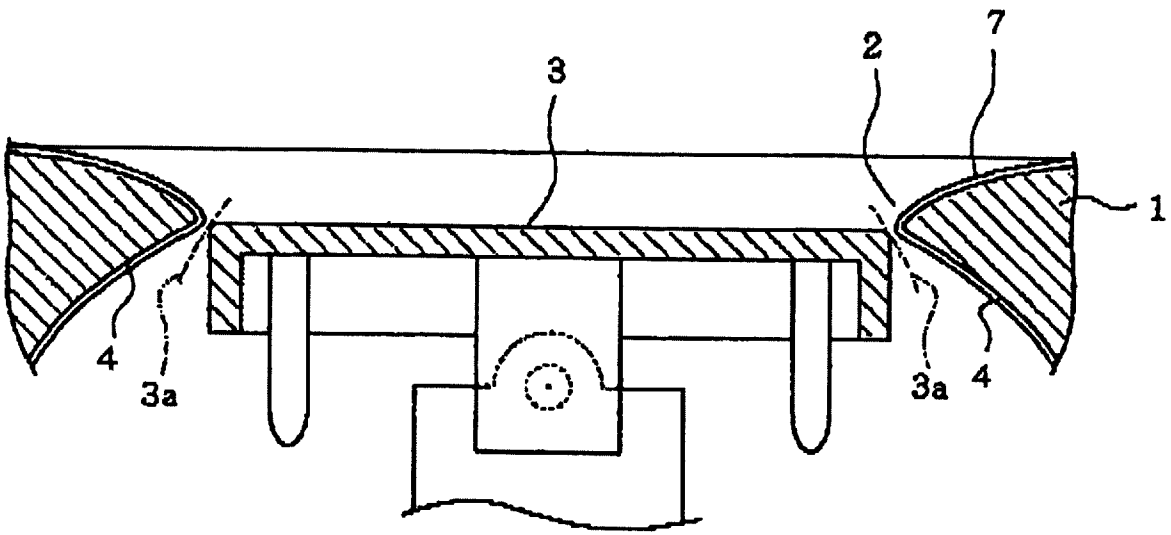
FIG. 4 is a vertical sectional view depicting a state in which a control knob is disposed within an opening in the switch cover.

Hereinafter, an embodiment of the invention will be described by reference to FIG. 1.

A switch cover 11 is disposed above a switch body 12 and has an opening 13. A circuit board 14, which is made up of a printed circuit board, is disposed below the switch body 12. A rubber sheet 15 is provided on an upper surface of the circuit board 14. Dome-shaped rubber contact portions 16 are provided in two locations on the rubber sheet 15 as viewed in FIG. 1. Each rubber contact portion 16 has integrally a cylindrical portion 17 and an elastically deformable skirt-like portion 18 which is provided on a lower side of the cylindrical portion 17, and a movable contact 19 is provided on a lower surface of the cylindrical portion 17. A pair of fixed contacts 20*a*, 20*b* are provided at a portion which confront the movable contact 19. A switch 21 is made up of the movable contact 19 and the pair of the fixed contacts 20*a*, 20*b*.

A switch controlling control knob 22 is disposed within the opening 13. This control knob 22 is attached to the switch body 12 via a shaft portion 23 disposed therebelow in such a manner as to oscillate. Two pressing projecting portions 24 are provided integrally on a lower surface of the control knob 22 in such a manner as to be positioned above the two rubber contact portions 16. A pusher 25 is disposed between the pressing projecting portion 24 and the rubber contact portion 16 which corresponds to the pressing projecting portion 24.

Next, the switch cover 11 will be described. The switch cover 11 is made up of a first resin layer 30 which defines a rear side of the switch cover 11 itself, a second resin layer 31 which is provided on an upper surface side (a front surface side) of the first resin layer 30, and a film-like plated layer 32 which is provided on a surface of the second resin layer 31.

In these layers, the first resin layer 30 is formed through molding of a resin material having a property in which the plated layer 32 does not adhere thereto. In the case of this embodiment, the first resin layer comprises a polycarbonate. The opening 13 is formed in the first resin layer 30 when the first resin layer 30 is molded, and an escape portion 33 is formed on a lower side of the first resin layer 30, which constitutes the rear side of the switch cover 11, in a position surrounding the opening 13 for permitting the oscillation of the control knob 22. In this case, a parting line 30*a* for molding the first resin layer 30 is set in a lower corner portion of the opening 13.

The second resin layer 31 is formed through molding of a material having a property in which the plated layer 31 easily adheres thereto. In the case of this embodiment, the second resin layer comprises an ABS resin on an upper surface side of the first resin layer 30 in such a manner as to become integral with the first resin layer 30. Consequently, the first resin layer 30 and the second resin layer 31 are formed integrally though the so-called two-color molding. In this case, the second resin layer 31 is formed in such a manner that a portion thereof which surrounds a circumferential edge portion of the opening is positioned close to an outer circumferential portion of the opening 13 in the first resin layer 31 (that is, is located in a position which recedes slightly (by a distance equal to the thickness of the plated layer 32) outwards from the opening 13). In addition, the plated layer 32 is made of chrome plating and is provided on the surface of the second resin layer through electroplating. An inner circumferential surface, which lies to face the opening 13, of the plated layer becomes level with an inner circumferential surface of the first resin layer 30.

In the configuration that has been described heretofore, in such a state that the control knob 22 is not operated, as is shown in FIG. 1, the control knob 22 is held in a substantially horizontal state. When a left-hand side of the control knob 22 as viewed in FIG. 1 is operated to be depressed from the substantially horizontal state, the control knob 22 rotates in a counterclockwise direction about the shaft portion 23. As the control knob 22 so rotates, the left-hand rubber contact portion 16 is depressed downwards via the left-hand pressing projecting portion 24 and pusher 25. Then, the cylindrical portion 17 moves downwards while elastically deforming the skirt-like portion 18 of the rubber contact portion 16, and the movable contact 19 is brought into contact with the pair of fixed contacts 20*a*, 20*b*, whereby the switch 21 becomes on.

When the pressure being exerted on the control knob 22 is released from this state, the skirt-like portion 18 of the left-hand contact portion 16 which has been kept depressed until then is restored from the elastically deformed state, and in conjunction with this, the cylindrical portion 17 and the pusher 25 move upwards, whereby the left-hand side of the control knob 22 is pushed upwards via the left-hand pressing projecting portion 24. As this occurs, as the cylindrical portion 17 of the rubber contact portion 16 moves upwards, the movable contact 19 moves apart from the fixed contacts 20*a*, 20*b*, and the switch 21 becomes off.

In addition, when a right-hand side of the control knob 22 is operated to be depressed, the control knob 22 only rotates in an opposite direction to the direction in which it rotates when the left-hand side thereof is depressed, and the other actions involved in such a rotation remain the same as those occurring when the control knob 22 is depressed on the left-hand side thereof.

According to the embodiment that has been described heretofore, the following function and advantage can be obtained. In the switch cover 1, the first resin layer 30 which defines the opening 13 is molded of the material (polycarbonate, in this case) to which the plated layer 32 does not adhere. This first resin layer 30 is made to define the rear sides of the opening 13 and the switch cover 11. Then, the second resin layer 31 is molded of the material (ABS resin, in this case) to which the plated layer 32 can adhere on the front surface side of the first resin layer 30, and the first resin layer 30 and the second resin layer 31 are formed integrally with each other. Thereafter, the plated layer 32 is formed on the surface of the second resin layer 31. As this occurs, since the plated layer 32 does not adhere to the exposed surface of the first resin layer 30, the plated layer 32 is not formed on the inner circumferential surface of the opening 13 which is formed by the first resin layer 30. Because of this, in molding the first resin layer 31, even in the event that a parting line 30*a* is set on the circumferential edge portion of the opening 13 and a flash is formed thereon, since the plated layer 32 does not adhere to the flash so formed, the stripping off of the plated layer 32 can be prevented which would otherwise be initiated therefrom. Consequently, even with the configuration in which the plated layer 32 is attempted to be provided on the surface of the switch cover 11 having the opening shape which makes it difficult to carry out the flash removal work, the stripping off of the plated layer 32 can be prevented by the simple configuration in which the parting line 30*a* is set on the opening portion of the first resin layer 30 to which the plated layer does not adhere. In addition, the necessity of performing the flash removing operation can be obviated.

The invention is not limited to the embodiment only but can be modified or developed further in the following way.

Any resin materials other than polycarbonate can be used as the first resin layer 30 which defines the switch cover 11, provided that the plated layer 32 does not adhere to those resin materials. In addition, the resin material used to mold the second resin layer 31 is not limited to the ABS resin, and hence, any other resin materials can be used, provided that the plated layer 32 is allowed to easily adhere to those resin materials. For example, a polyamide resin may be used to mold the plated layer 32.

The control knob is not limited to the one which can oscillate, and hence, a rotary control knob may be adopted.

What is claimed is:

1. A switch unit comprising:

a switch cover having an opening;

a knob for operating a switch, the knob being provided within the opening in such a manner as to oscillate or rotate; and a parting line is set on a circumferential edge portion of the opening of the switch cover, wherein the switch cover comprises:

a first resin layer which is molded of a resin material having a property in which a plate layer does not adhere thereto, which forms the opening and which defines a rear side of the switch cover, the first resin layer including the parting line;

a second resin layer which is molded of a resin material having a property in which the plate layer can adhere thereto, and the second resin layer is integrally formed on a surface side of the first resin layer in such a manner as to form a recess away from the opening to accommodate a thickness of the plate layer which substantially aligns with the opening; and the plate layer which is provided to cover a surface of the second resin layer;

wherein the parting line is set in a vicinity of a peripheral locus of the knob on the circumferential edge portion of the opening of the switch cover.

2. The switch unit according to claim 1, wherein the resin material of the first resin layer comprises a polycarbonate and the resin material of the second resin layer comprises an ABS resin or a polyamide resin.

3. The switch unit according to claim 1, wherein the parting line is a line which indicates a border between the first resin layer and the second resin layer.

* * * * *